US005080530A

United States Patent [19]

Crawford et al.

[11] Patent Number: 5,080,530

[45] Date of Patent: Jan. 14, 1992

[54] LAYING UNDERWATER CABLES

[75] Inventors: Stuart Crawford; Philip Sykes, both of Kent, Great Britain

[73] Assignee: STP PLC, London, United Kingdom

[21] Appl. No.: 737,813

[22] Filed: Jul. 29, 1991

Related U.S. Application Data

[63] Continuation of Ser. No. 492,735, Mar. 13, 1990, abandoned.

[30] Foreign Application Priority Data

Mar. 13, 1989 [GB] United Kingdom ..... 8905736

[51] Int. Cl.[5] ..... F16L 1/04

[52] U.S. Cl. ..... 405/163; 114/77 R; 405/158

[58] Field of Search ..... 405/195, 196, 162-165, 405/169, 168; 114/77 R, 77 A, 72, 244

[56] References Cited

U.S. PATENT DOCUMENTS

| | | | |
|---|---|---|---|
| 3,136,529 | 6/1964 | Dickinson et al. | 114/244 X |
| 3,751,927 | 8/1973 | Perot | 405/162 X |
| 3,790,009 | 2/1974 | Hauber | 405/196 X |
| 4,040,265 | 8/1977 | Hellerman et al. | 405/196 |
| 4,091,629 | 5/1978 | Gunn et al. | 405/163 X |
| 4,476,798 | 10/1984 | Backus | 114/77 R |
| 4,528,928 | 7/1985 | Vivta et al. | 114/77 R X |
| 4,765,776 | 8/1988 | Howson | 405/169 |

FOREIGN PATENT DOCUMENTS

| | | | |
|---|---|---|---|
| 0136696 | 11/1978 | Japan | 405/168 |

*Primary Examiner*—Dennis L. Taylor
*Attorney, Agent, or Firm*—Lee, Mann, Smith, McWilliams & Sweeney

[57] ABSTRACT

A freighter or coaster is temporarily converted for cable laying by an accommodation and power module, a stern side thruster and control and deployment equipment, all of which is removable after completion of the lay for the vessel to return to its normal operation.

5 Claims, 4 Drawing Sheets

LAYING UNDERWATER CABLES

This application is a continuation of application Ser. No. 492,735, filed Mar. 13, 1990 now abandoned.

This invention relates to laying underwater cables, particularly telecommunication fibre optic cables but not exclusively so.

Underwater telecommunication cables have in the past been laid by large purpose-built cable laying ships such as the cable ship Mercury owned and operated by Cable and Wireless, and Alert owned and operated by British Telecom. Both these ships are suited to laying cables in deep water up to the deepest ocean waters in the world.

A problem with such purpose-built cable laying ships is that they cannot work in very shallow water, particularly approaching landfalls, because they are large e.g. 11000 tons. They are also expensive to operate, not only because they are large but more importantly because they are only employed for cable laying on average for a small portion of the year. For the rest of the year they either lay idle or are "adapted" for other uses such as underwater surveys.

The cable laying ships mentioned above require at least 20 fathoms of water and so where the cable approaches a land fall then the cable is usually held afloat by flotation devices and a manually-operated barge used to lay the cable to the shore.

In shallow waters particularly in areas where fishing is prevalent it is becoming increasingly desirable to bury the cable so that it does not become damaged. Trawler equipment particularly large beam trawls can completely sever an underwater cable. Our earlier patent (GB1595513) proposed a unique cable design which proved highly resistant to trawler damage in the North Sea and has been adopted on submarine cable links. Burial is a successful alternative solution to the problem (it can be combined with it also).

It is known to use burial equipment either in the form of a plough or a burial head which uses water jets (fluidisation) to make a trench in the sea bed and allows the sediment to settle back and re-fill the trench with the cable in it.

It has also been proposed to provide both air and water jets in an injection head and the German company Harmstof have designed such a head carried on a sled. These techniques require a diver to control or at least direct the operation from the sea bed.

Smaller purpose-built cable laying ships exist but these vessels being purpose-built are still unecomonic unless they can be kept working for a substantial proportion of the year. There is no small e.g. 500–1000 deadweight tonnage purpose-built cable laying ship which is designed for burying cables.

In an attempt to economise it has been proposed to convert existing commercial vessels for cable laying and burying. The ship CABLE PROTECTOR has a deadweight tonnage just under 3000 tonnes is a flatback oil rig supply vessel previously used for carrying drill pipes, mud shifting and diver support functions. It has been converted to cable laying by the addition of a linear cable engine, cable tanks on deck, control cabin and using the existing accommodation for the cable laying crew, and in addition if we have the CIRRUS vehicles for ROV support, a central console cabin for the ploughing rig, with additional diesel engine power plant for providing hydraulic and electric power. It already has some of the other necessary hydraulic, pneumatic and electrical generation plants to provide for the cable laying and burial processes.

A flatback is not ideal because the cable is stored on deck and is therefore afforded little protection. Such an arrangement is less suited to bad weather conditions. Furthermore these vessels still suffer from a point of view of economy of operation because they are expensively equipped and they are not very suitable for deeper water applications and bad weather conditions.

It is an object of the present invention to provide a more cost-effective way of laying and burying cables particularly in shallow water but not exclusively.

According to the present invention there is provided a vessel such as a coaster or freighter temporarily converted for cable laying and comprising in addition to its normal operational equipment an accommodation and power container providing accommodation needs for a cable laying crew including sleeping, bathing, eating and toilet facilities, and power for powering a stern thruster; a cable laying machine for laying a cable from the vessel; and control and deployment equipment for deploying the cable from the hold of the vessel via the laying machine and controlling laying of the cable; said container, laying machine and control and deployment equipment being removable from the vessel and re-useable.

According to another aspect of the present invention there is provided cable laying equipment for converting a vessel such as a freighter or coaster for cable laying on a temporary basis, comprising a) an accommodation and power container providing the accommodation needs for a cable laying crew including sleeping, bathing, eating and toilet facilities, and power for powering a and a stern thruster;
b) a cable laying machine for laying the cable from the vessel; and
c) control and deployment equipment for deploying cable from the hold of the vessel via the laying machine and controlling laying of the cable.

According to another aspect of the invention there is provided a method of operating a vessel such as a coaster whose normal operation is to transport goods in its hold from one port where the goods are loaded into its hold to another port, comprising temporarily converting the vessel by installing in the hold a self-contained accommodation and power module to accommodate a cable-laying crew and provide additional hydraulic and electric power, over and above that required for normal operation of the vessel, loading a cable into the vessel's hold and laying the cable using the temporarily-converted vessel, and then removing the module and subsequently using the vessel to transport goods again.

In order that the invention can be clearly understood reference will accompanying drawings in which.

Figure 1:
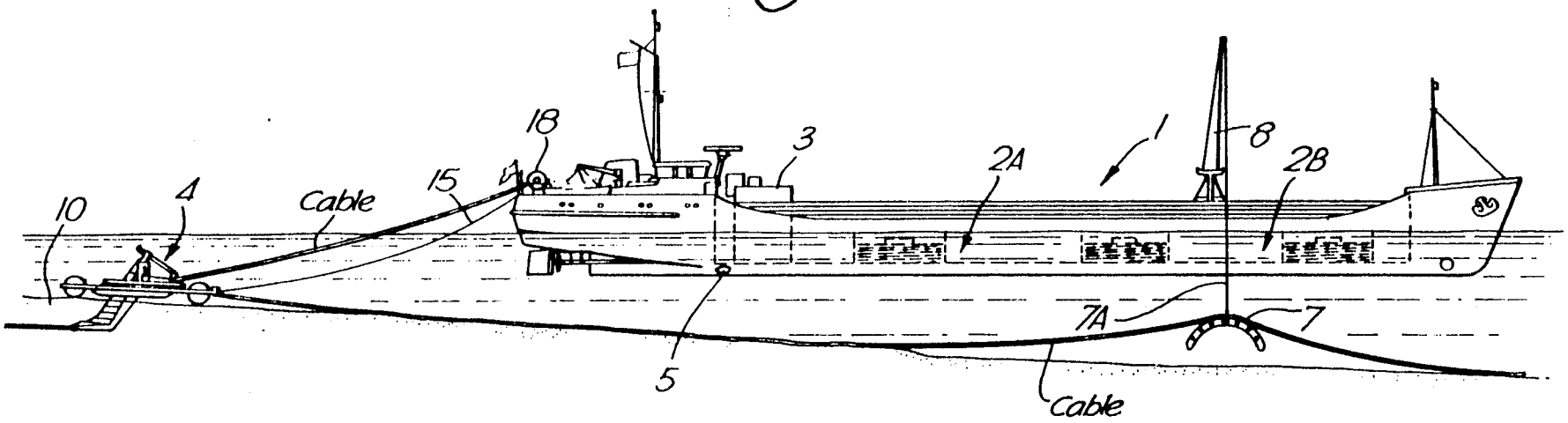
FIG. 1 is a general side view of a coaster temporarily converted for cable laying according to an embodiment of the present invention.

Referring to FIG. 1 the vessel shown is a coaster having a deadweight tonnage of about 1200 tonnes. She has a waterline length of about 80 m and a beam of 10 m. Her normal operation would be as a cargo conveyer of, say, coal, iron or mixed cargo etc in her hold between ports. Her gross tonneage is about 1500 tonnes. She is diesel-powered with twin screws, having two 2000 H.P. diesel engines giving her a normal operational speed of about 15 knots. In common with many vessels these days, she has a bow thruster to improve manoeuvrability when docking and undocking. She would normally have a crew of five.

As shown the vessel has been temporarily converted for cable laying by the installation of an accommodation and power module 3, a cable laying engine 16, a cable burying machine 4, a side thruster 5 and a burial machine hawser winch 6. Also a dancing sheave 7 has been provided, supported from a jib 8 which is already present on the vessel for shifting cargo.

The ship has two holds 2A and 2B ( others may have a single hold).

Figure 2A:
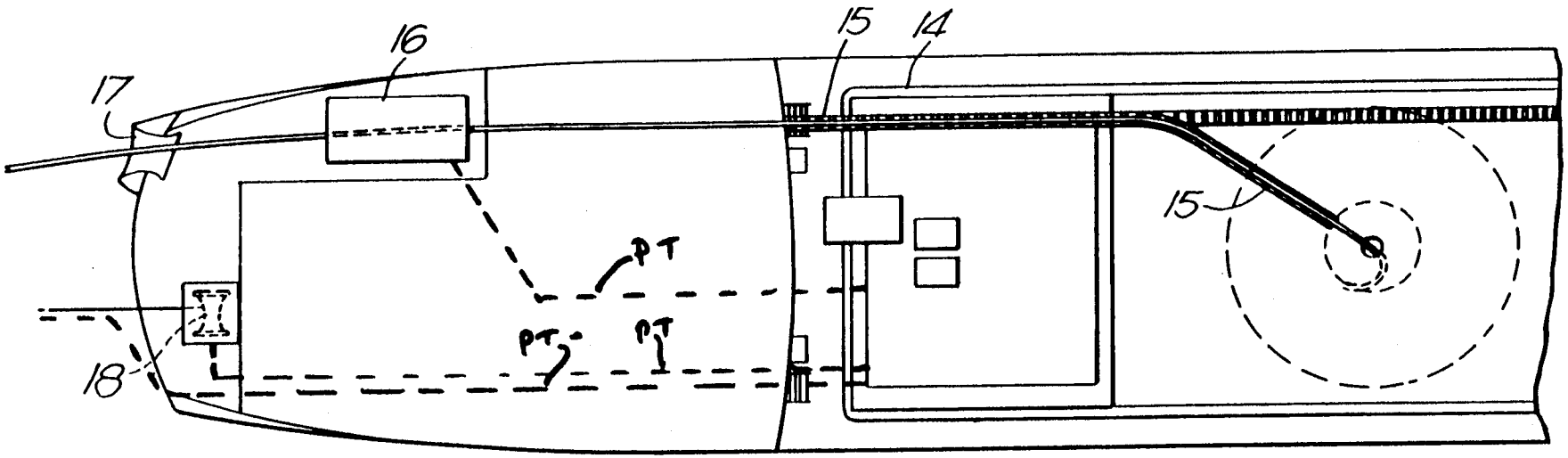
FIG. 2A is an upper plan view of the rear half of the converted vessel of FIG. 1 on a larger scale.
Figure 2B:
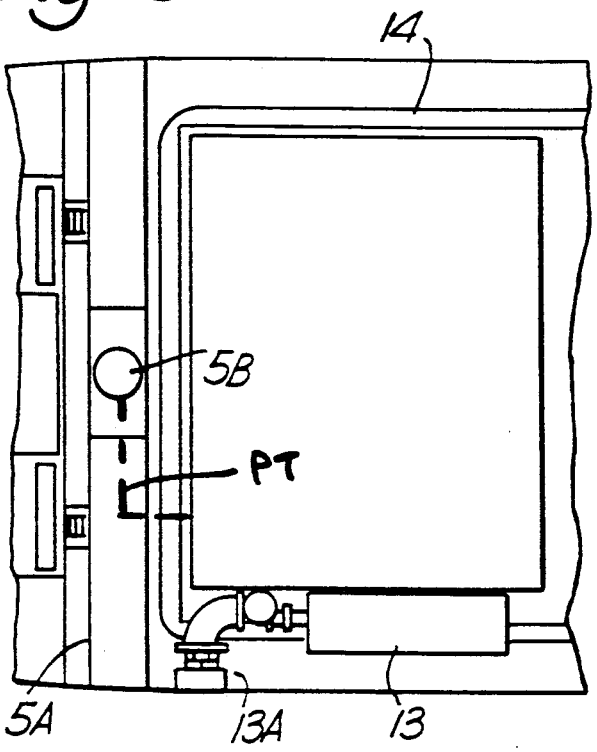
FIG. 2B is a low plan view of part of the rear half of the converted vessel.
Figure 2C:
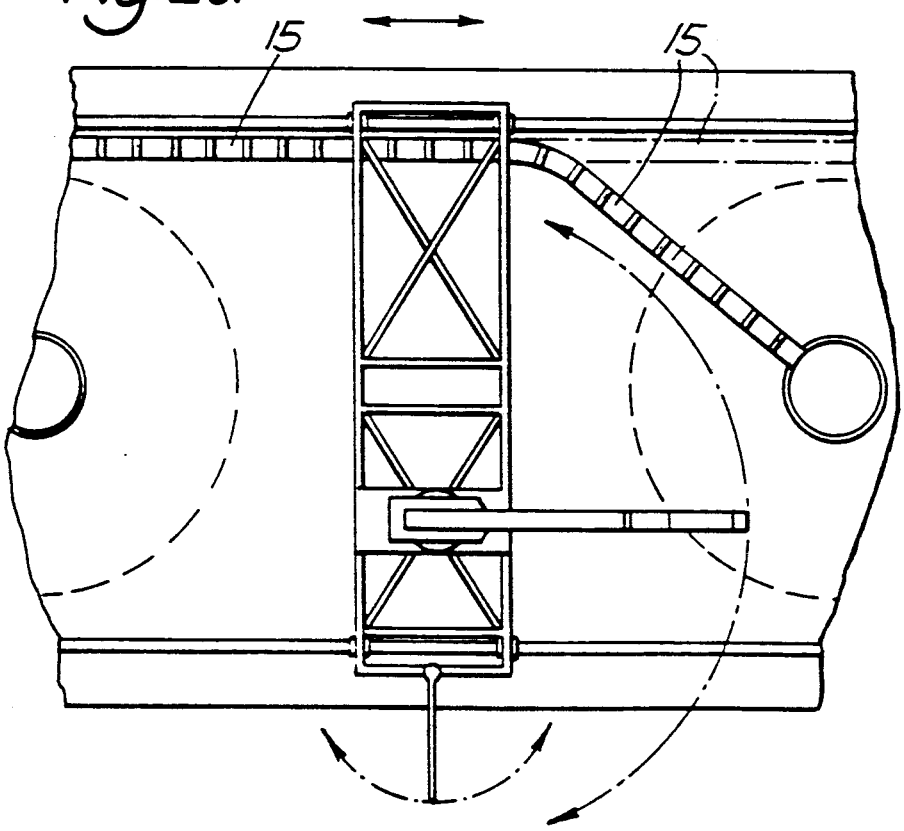
FIG. 2C shows part of the forward portion of the vessel and details of the crane.
Figure 3:
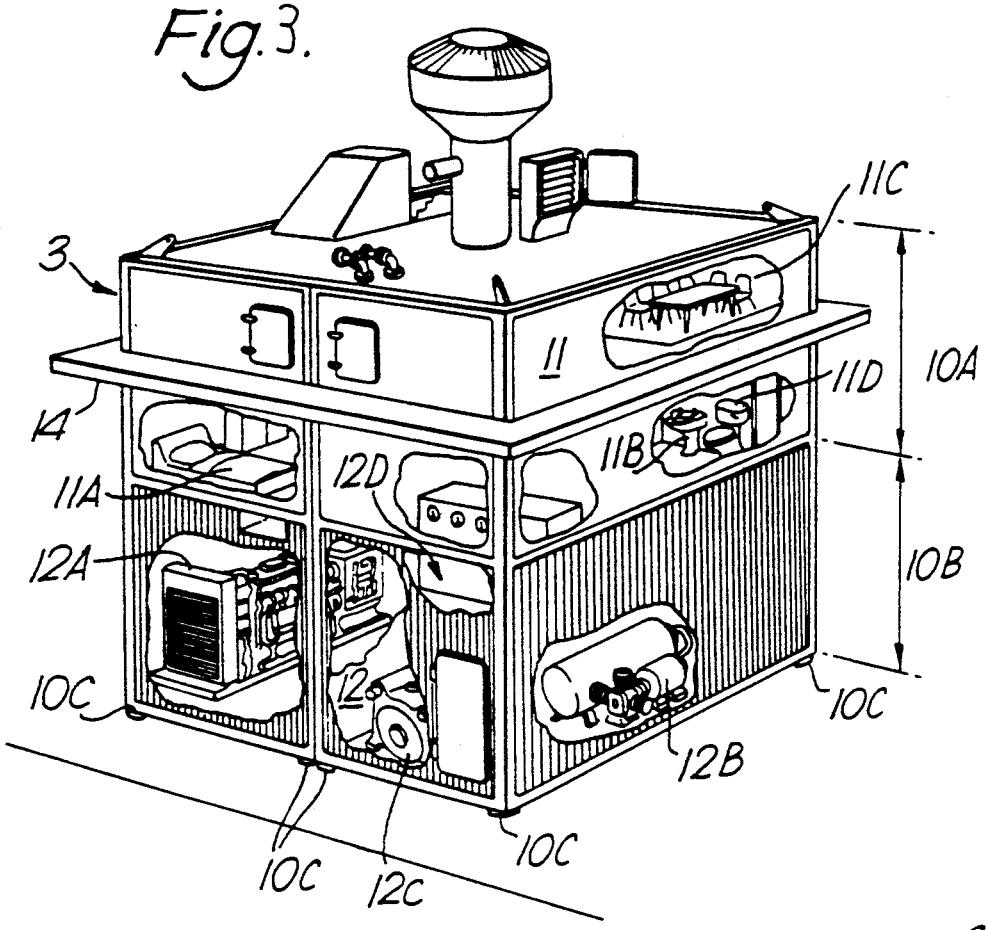
FIG. 3 shows in perspective and somewhat schematically power and accommodation module for the vessel.
Figure 4:
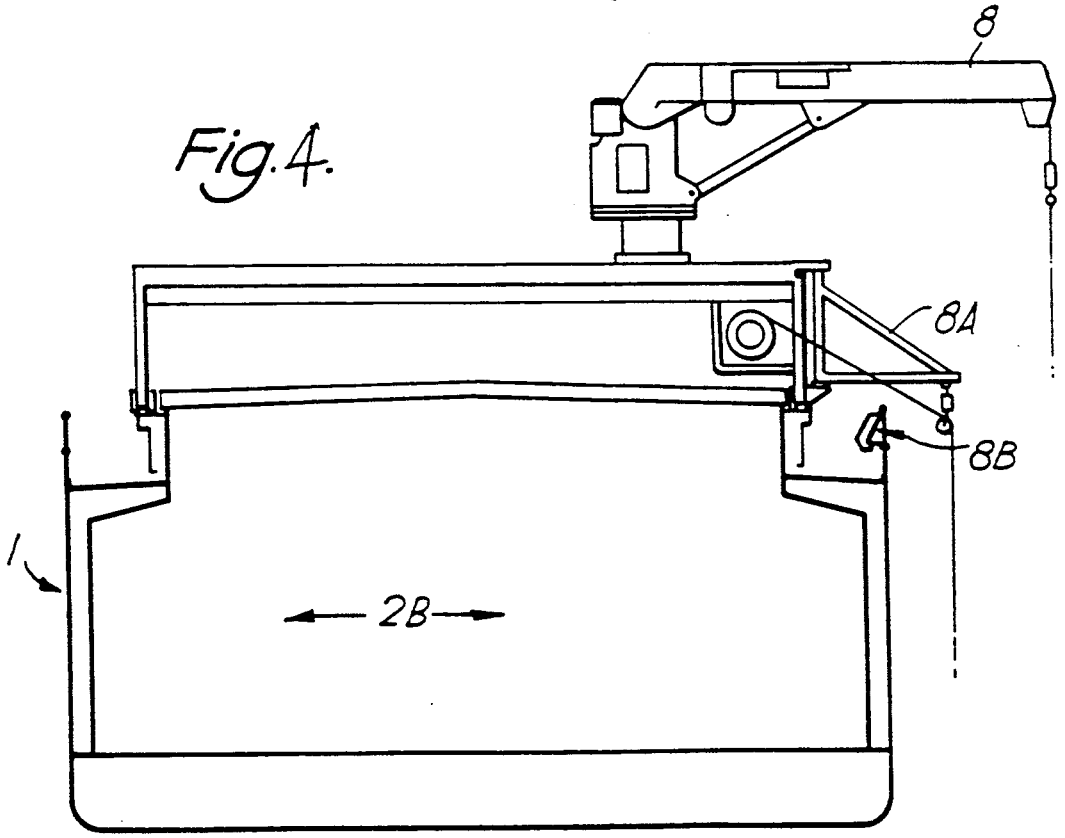
FIG. 4 is a cross section of the vessel hull showing the crane and the dancing sheave arrangement.

The power and accommodation module 3 is shown in greater detail in FIG. 3. It comprises rectangular steel boxes 10A, 10B together about the size of four standard cargo containers having upper accommodation compartments 11 including sleeping 11A, bathing 11B, eating 11C and toilet 11D facilities and lower power supply compartments 12 including a 300 KVA generator 12A, an air compressor 12B and a hydraulic power source 12C. A control system 12D provides control over the equipment. The power sources are primarily to power the cable engine and the stern thruster but may also power the cable burial equipment, and the power transfer connections are represented schematically in FIGS. 2A to 2C by broken lines PT between module 3 and the thruster 5B, the cable engine 16 and the winch 18 and the burial machine 4.

The module 3 sits in the rear of the hold 2A and is held in place by welds between the base feet 10C of the module and the floor of the hold 2A and between the side walls of the top box 10A and a modified hatch cover 14. These welds can easily be cut through when the module is removed.

A stern side thruster 5 is installed athwartships and comprises a thruster tube 5A and hydraulic impeller 5B driven by the hydraulic pump 12C in the lower half 10B of the module 3. The side thruster is used to control sideways movement of the vessel when trenching the cable and particularly in light tidal waters and light wind to counteract their sideways effect on the vessel.

The side thruster tube is welded in place and to holes cut in the hull sides. This could be done in such a way that the welding can be cut through for removal after cable laying is finished and a plate welded over each side hole in the hull to render it water tight again. Alternatively the thruster tube can be left in place for future use, but disconnected from the power source in the accommodation and power module which is preferable since the tube takes up little space in the cargo hold.

A jet pump 13 (FIG. 2B) which is also installed temporarily is powered electrically from the generator 12A and has a suction pipe 13A. It supplies a powerful water jet via hoses (not shown but represented by PT) to injection ports of the burial equipment 4. This equipment is also part of the temporary conversion of the vessel and is removable after use for cable laying.

The burial equipment 4 weighs about nine tons and is towed by a hawser 15 behind the vessel to bury the cable as it is payed out from the vessel.

The conversion described is made and used as follows. A chartered suitable vessel such as the freighter or coaster shown, is sent to a shipyard for conversion which will take about one week. The main element of the conversion is the accommodation and power module which is craned onto the vessel, and removably welded in place. Also provided are:

a) the burial machine and associated jet pumps and tow winch which are loaded on board and the winch and jet pump secured down;
b) a dancing sheave jib and associated controls installed
c) stern side thruster installed (if not already present from the previous operation).
d) cable laying engine and cable run installed and
f) pre-fabricated cable tanks installed.

The vessel then moves to a cable loading berth and the cable is loaded. It then sails to the nearest port, jetty or sheltered anchorage to the starting end of the system.

The burial machine can either be assembled at this point and towed to the landing beach or assembled by the cable laying crew in the water alongside the vessel once the vessel is safely moored off the landing beach. The machine is then either floated onto the beach by means of ballast tanks, provided there is negligible surf, or kept floating alongside the parent vessel until the cable is landed.

Once the cable is landed the machine is engaged and lay and burial commences simultaneously. The ship moves away from the land drawing the burial machine from winch 18 with hawser 15 and deploying the cable from the cable drum in the hold via the cable run 19 cable engine 16 and over the stern skid 17.

The stern thruster 5 controls sideways drift of the vessel in conjunction with the bow thruster already normally present on the vessel.

The combination of air and water jets on the burial head and its weight (the ballast tanks are now filled with water) cause the head to dig a trench 10 as shown schematically in FIG. 1 with the cable buried at the bottom of the trench.

In this mode of operation the dancing sheave 7 and control are not used since cable lay and burial are simultaneous and in this mode the vessel can move "crabwise" to maintain direction under wind and tide.

However in an alternative mode the cable is first landed and laid without burial. Then the burial machine is deployed and divers put the cable into the dancing sheave 7 as shown in FIG. 1. In this mode the cable act as a guide line for steering the vessel as it moves away from the beach. The angle, which the lift wire 7A on the sheave takes is measured by the control 7B used by the operator, and used to position the vessel laterally over the cable.

A tension read-out from the jib head indicates whether these is excess slack in which case the sheave is lifted to reduce it, or excess tension in which case the sheave is lowered to reduce it.

The stern thruster 5 and the already existing forward thruster, both extending athwartships are controlled by the operator using a joystick, while the forward speed of the vessel is controlled by the laying meter on the bridge, using tow-line tension in the hawser 15 as its guide to the desired speed of the vessel. The vessel is kept aligned with the direction of lay of the cable.

At the end of burial in e.g. 100 fathoms of water, a diver goes down from the ship and disengages the cable from the dancing sheave and an entry bellmouth on the burial machine. With suitable mechanical control in place of a diver, burial could continue up to say 800 m of water.

The sheave 7 is then hoisted on the ship and the burial machine ballast tanks are "blown". It returns to the surface and is towed either to port or a place of shelter or to the next burial section of the cable system which normally would be the landfall at the other end of the system.

Thus the chartered freighter temporarily converted provides a suitable vessel for laying and burying cables anywhere in the world, and by removal of the accommodation and power module, the cable engine, drums, cable way, burying head and jet pump, and by disconnecting the power supply to the stern side thruster and ancillary controls, the freighter can continue working as a freighter again.

Such commissioning as a cable laying vessel and decommissioning back to a freighter takes about 1 week each time. Such a converted chartered freighter is cheap to run having a basic crew of only five plus the cable laying crew who are accommodated in the accommodation module.

What is claimed is:

1. A vessel such as a coaster or freighter having a cargo hold and temporarily converted for shore cable laying, the cargo hold providing storage for a shore cable to be laid, the vessel comprising in addition to its normal equipment:

(a) a stern thruster;

(b) a cable laying machine for laying and burying from the vessel the shore cable stored in the hold;

(c) a crew accommodation and power module secured within said hold and incorporating both power for the stern thruster and the cable laying machine and accommodation needs for a cable laying crew including sleeping, bathing, activity and toilet facilities;

(d) control and deployment equipment for deploying the shore cable stored in the hold via the laying machine and controlling laying and burying of the cable; and (e) means for removing said cable laying machine, accommodation and power module and control and deployment equipment from the vessel for reuse.

2. A vessel as claimed in claim 1, further comprising in addition a dancing sheave, said control and deployment equipment having means to determine the angle and tension in a line supporting the sheave when burying a cable already laid on the sea bed.

3. A vessel as claimed in claim 1, wherein said burial machine comprises a burial head having fluid nozzles, a transporting chassis for carrying the head on the sea bed, and a buoyancy device for stably floating the machine on the surface.

4. A vessel as claimed in claim 1, wherein said container is removably welded into a hold of the vessel.

5. A vessel as claimed in claim 1, and comprising in addition a cable storage drum removably secured in the hold of the vessel, a cable run removably secured in the hold and able to carry cable from the storage drum to a cable engine removably mounted near the stern of the vessel.

* * * * *